United States Patent [19]

Wood

[11] 4,349,103

[45] Sep. 14, 1982

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 208,917

[22] Filed: Nov. 21, 1980

[51] Int. Cl.[3] ..... B65D 75/00

[52] U.S. Cl. ..... 206/188; 206/193; 206/163

[58] Field of Search ..... 206/170, 175, 180, 184, 206/188, 193

[56] References Cited

U.S. PATENT DOCUMENTS

| | | | |
|---|---|---|---|
| 3,122,266 | 2/1964 | Forrer | 206/188 |
| 3,151,769 | 10/1964 | Woodling | 206/188 |
| 3,568,880 | 3/1971 | Harrelson | 206/188 |
| 3,572,542 | 3/1971 | Wood | 206/188 |
| 3,754,680 | 8/1973 | Wood | 206/188 |
| 4,084,688 | 4/1978 | Hughes | 206/188 |

*Primary Examiner*—Joseph Man-Fu Moy
*Attorney, Agent, or Firm*—Erwin Doerr

[57] ABSTRACT

This invention relates to a cellular article carrier in which partitioning means forming a plurality of individual article cells is provided on each side of a medial partition structure. The medial partition includes a multi-ply handle structure comprising an outer handle structure secured in overlapping relationship with respect to an inner handle structure and extending between opposite end walls of the carrier, the outer handle structure including reinforcing straps hinged thereto and secured to the end wall panels at one end of the carrier.

8 Claims, 7 Drawing Figures

ARTICLE CARRIER AND BLANK THEREFOR

Figure 1:
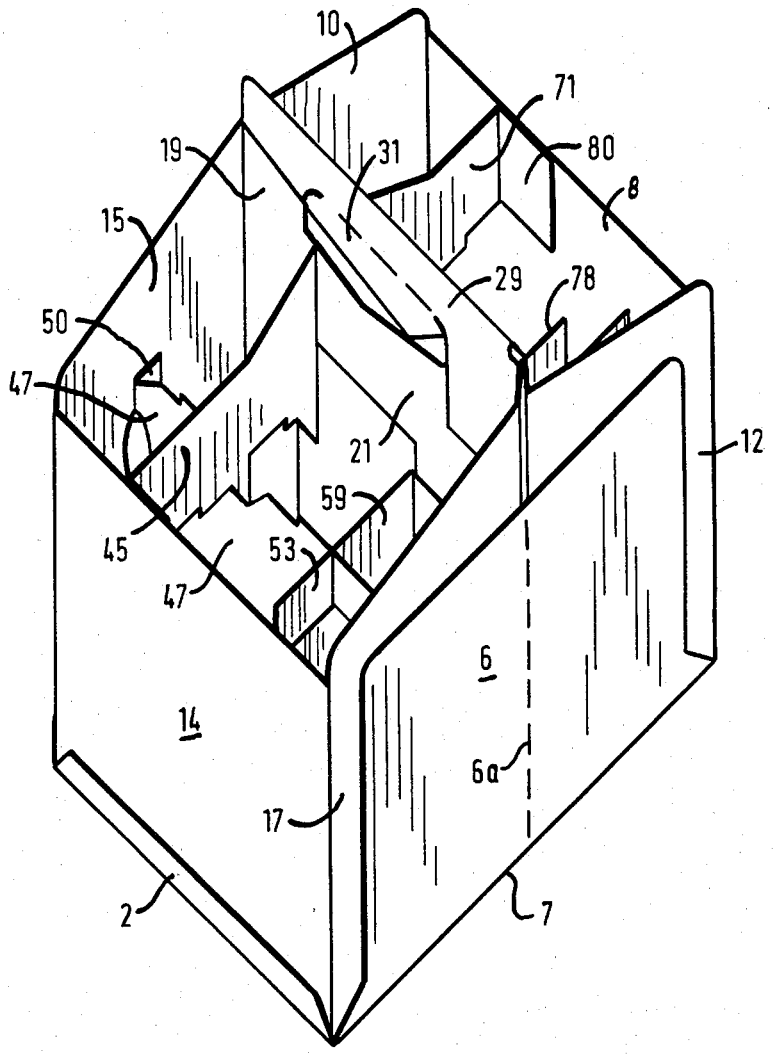

This invention relates to cellular article carriers in which two rows of articles such as bottles are accommodated on each side of a central handle.

A similar article carrier is disclosed and claimed in my earlier U.S. Pat. No. 4,146,129 which has issued on Mar. 7, 1979 and is owned by the assignee of this invention.

The present arrangement constitutes an improved version of my earlier article carrier and is particularly concerned with the reinforcement of the central handle and the construction of the medial and transverse partitions.

According to one aspect of this invention, the article carrier is formed from a unitary blank of sheet material and comprises a medial partition structure at one end of the carrier hinged to said end wall panels at said one end and extending medially inward of the carrier, a medial partition structure at the other end of the carrier hinged to said end wall panels at said other end and extending medially inward of the carrier, partitioning means providing a plurality of individual article cells on each side of said medial partition structures, and inner handle structure provided by the medial partition structure at said one end of the carrier and an outer handle structure secured in overlapping relationship with respect to said inner handle structure and extending between the opposite end wall panels of the carrier, said outer handle structure including reinforcing straps hinged thereto and secured to the end wall panels at said one end of the carrier.

Another aspect of the invention provides an article carrier blank comprising a pair of first medial panels hinged together at one end of the blank about a central fold line, a pair of first end wall panels hinged to respective ones of said first medial panels, a pair of side wall panels hinged to respective ones of said first end wall panels remote from said first medial panels, a pair of second end wall panels hinged to respective ones of said side wall panels remote from said first side wall panels and a pair of second medial panels hinged together at the other end of the blank about a central fold line and hinged to respective ones of said second end wall panels remote from said side wall panels, and wherein a pair of outer handle panels are struck in part from each of said first end wall panels and in part from each of said side wall panels and hinged together about a central fold line, said outer handle panels being hinged at one of their ends to respective ones of said first medial panels and at the other of their ends to respective ones of a pair of reinforcing straps, said reinforcement straps being further hinged to respective ones of said second end wall panels.

Yet another aspect of the invention provides a cellular article carrier comprising a bottom wall, spaced side walls hinged respectively to opposite side edges of the bottom wall, end wall panels hinged respectively to the end edges of said side walls and extending inwardly therefrom, medial partition structure hinged to the edges of said end wall panels remote from said side walls and extending medially inward of said carrier, said medial partition structure comprising a pair of medial panels, a pair of transverse partitions struck from one of said medial panels and hinged thereto, a longitudinal partition struck from said one medial panel and hinged to said pair of transverse partitions, a pair of longitudinal partitions struck from one of said end wall panels and hinged thereto, a transverse partition struck from the other of said medial panels and from said one end wall panel and hinged to said pair of longitudinal partitions and to said other medial panel and wherein said one longitudinal partition is connected to one of said pair of longitudinal partitions in face to face overlapping relationship.

Figure 2:
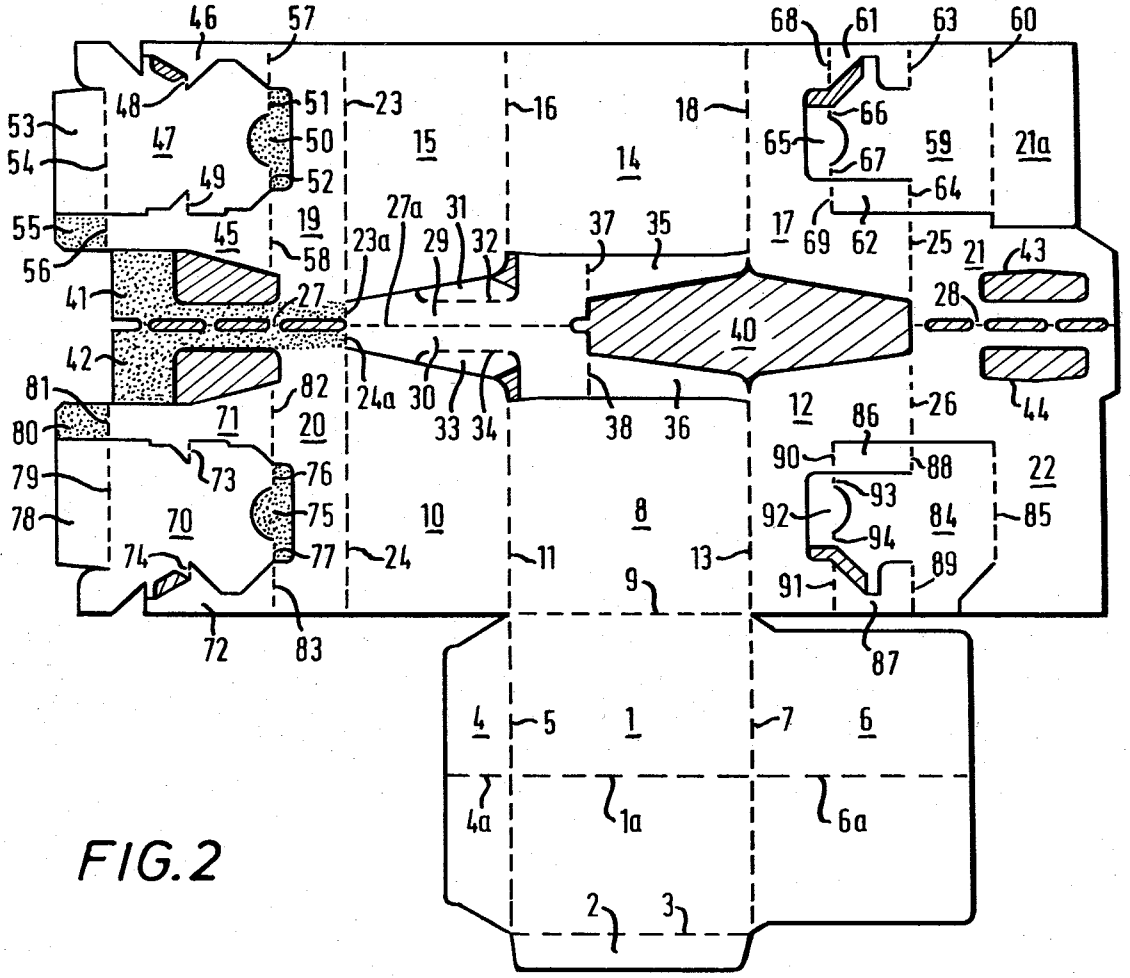
Figure 3:
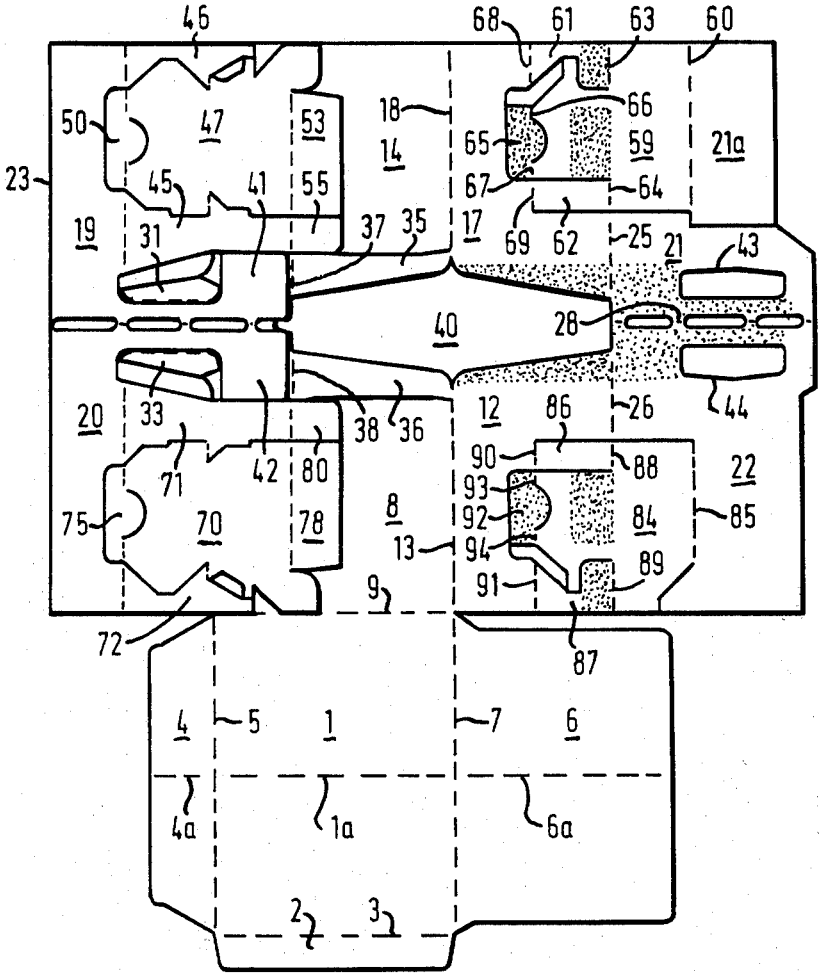
Figure 4:
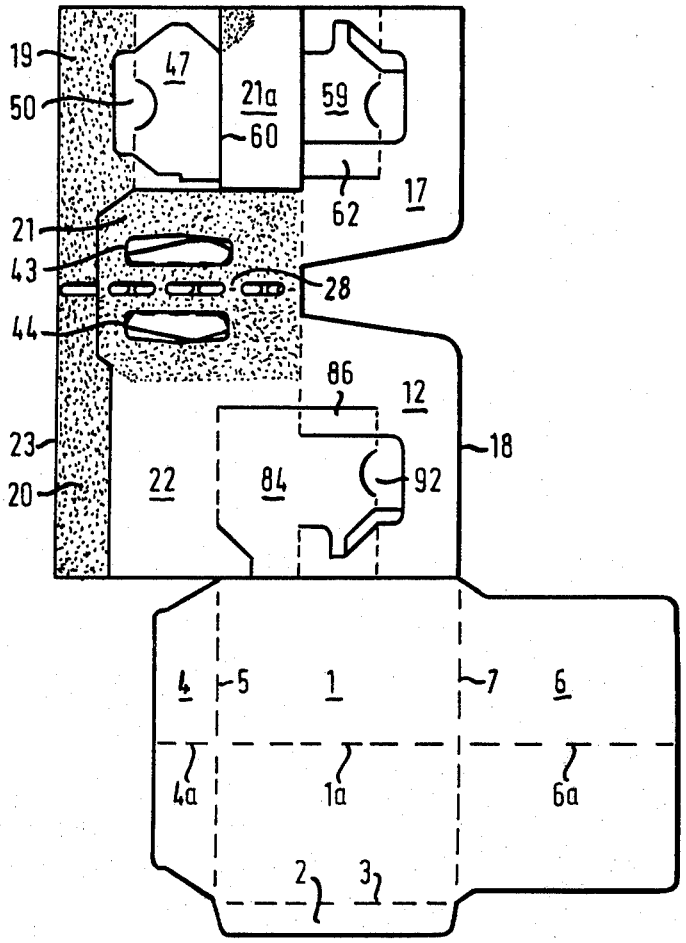
Figure 5:
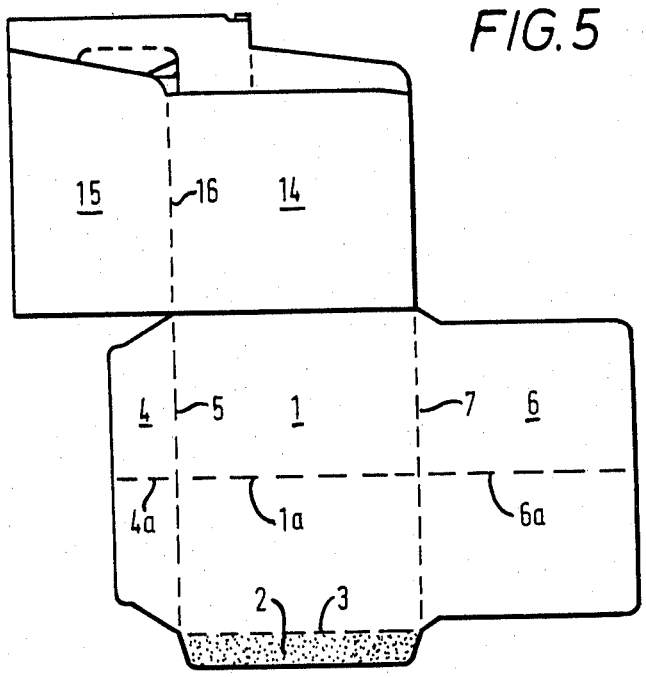
Figure 6:
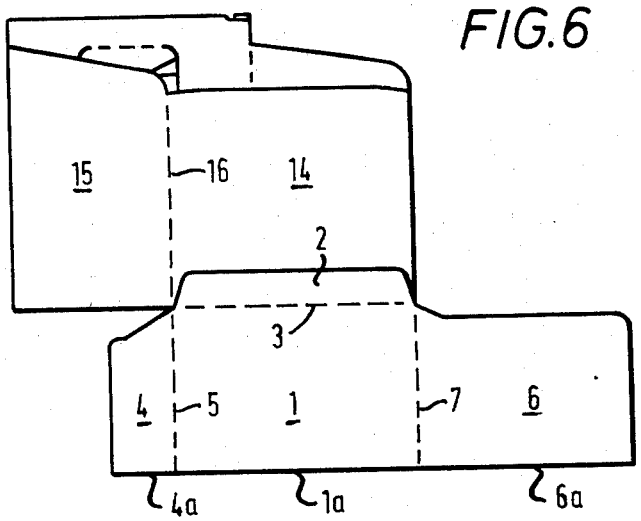
Figure 7:
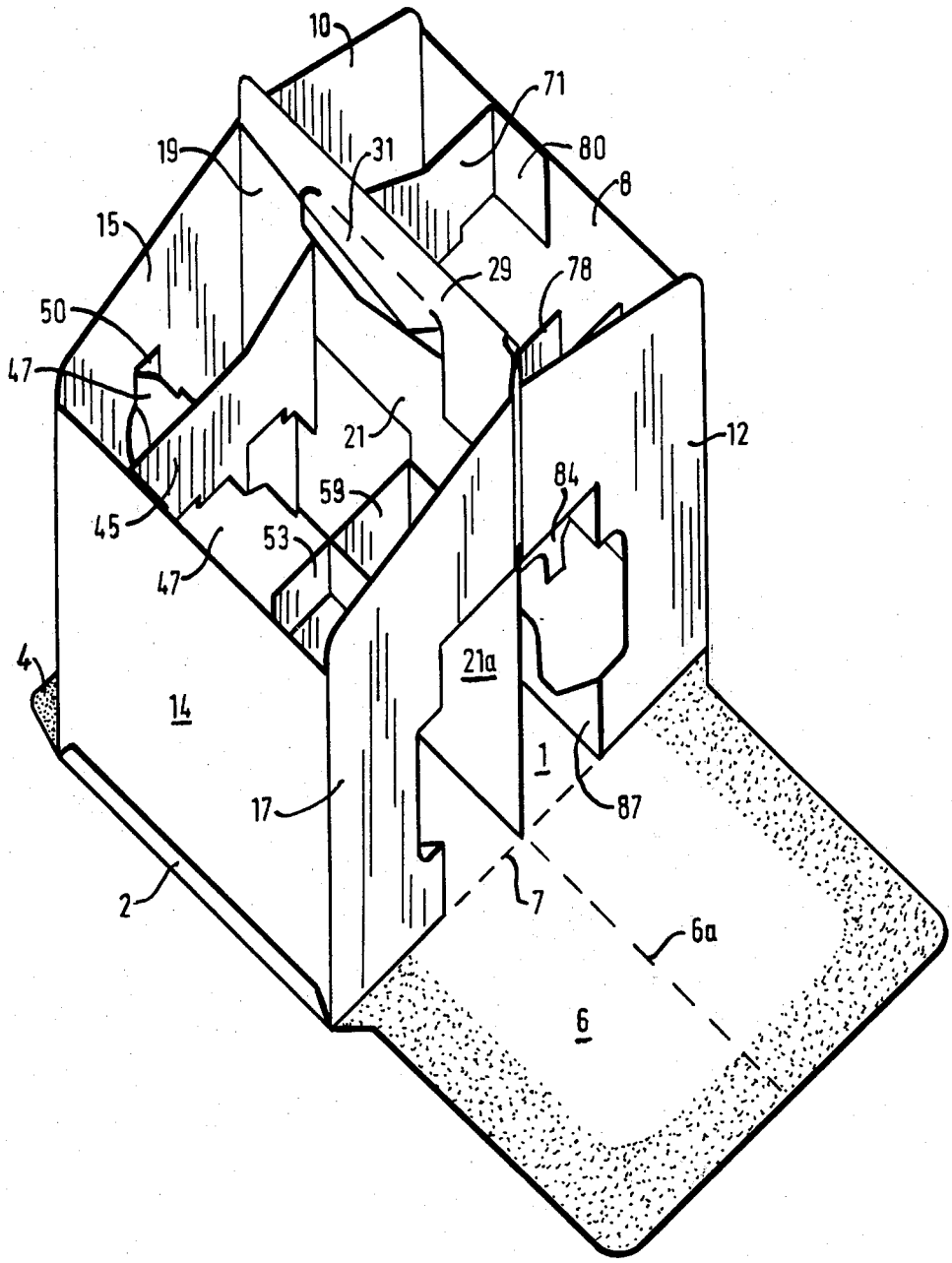

For a better understanding of the invention, reference is now made to the following detailed description taken in conjunction with the accompanying drawings, in which:

FIG. 1 is an isometric view of an erected carrier formed according to this invention, FIG. 2 is a plan view of a unitary blank from which the carrier shown in FIG. 1 is formed, FIGS. 3, 4 and 5 illustrate intermediate steps through which the blank is manipulated in order to form the complete and collapsed carrier shown in FIG. 6 and, in which FIG. 7 is an isometric view of a partially formed carrier.

In the drawings and with particular reference to FIG. 2, the numeral 1 designates the bottom wall of the carrier to a side edge of which glue flap 2 is hinged along a fold line 3. An auxiliary glue flap 4 is hinged to bottom wall 1 along fold line 5 and an auxiliary panel 6 is hinged to bottom wall 1 along fold line 7 formed parallel to fold line 5. The bottom wall 1, auxiliary glue flap 4 and auxiliary panel 6 are all provided with aligned medial fold lines 1*a*, 4*a* and 6*a*, respectively.

A side wall 8 is hinged to the bottom wall 1 along a fold line 9 extending parallel to the aligned medial fold lines. To one end edge of side wall 8, an end wall panel 10 is hinged along fold line 11. Similarly, end wall panel 12 is hinged to the opposite end edge of side wall 8 along a fold line 13 parallel to fold line 11.

The opposite side of the blank is constructed in a similar manner and includes a side wall 14 to an end edge of which end wall panel 15 is hinged along a fold line 16. Similarly, end wall panel 17 is hinged to side wall 14 along a fold line 18 parallel to fold line 16.

Medial partition structures for the carrier are provided and include medial panels 19, 20, 21 and 22. Medial panels 19 and 20 are hinged respectively to end wall panels 15 and 10 along aligned fold lines 23 and 24. In a similar manner the medial panels 21 and 22 are hinged respectively to end wall panels 17 and 12 along aligned fold lines 25 and 26. The medial panels 19 and 20 are hinged together along an interrupted centre fold line 27 and similarly medial panels 21 and 22 are hinged together along interrupted centre fold line 28.

In order to facilitate transport of the carrier, an outermost handle structure is provided and which comprises handle panels 29 and 30 which are mirror images of one another about a central fold line 27*a* which is an extension of the interrupted centre fold line 27. Handle panel 29 is struck partially from the end wall panel 15 and partially from side wall 14 and has one of its ends hinged to medial panel 19 along a fold line 23*a* which is aligned with the fold line 23. A hand gripping aperture is struck from the outer edge of the handle panel 29 and is defined by a hand cushioning flap 31 hinged to the handle panel 29 along a short fold line 32.

Similarly, the handle panel 30 is struck partially from the end wall panel 10 and partially from the side wall 8 and has one of its ends hinged to medial panel 20 along fold line 24*a* which is aligned with the fold line 24. A hand gripping aperture is struck from the outer edge of the handle panel 30 and is defined by a hand cushioning flap 33 hinged to the handle panel 30 along a short fold line 34.

The handle panels 29 and 30 are connected to end walls 17 and 12 by means of handle reinforcing straps 35 and 36, respectively. Reinforcing strap 35 is struck from the side panel 14 and is hinged at one of its ends to the end of handle panel 29 remote from medial panel 19 along a fold line 37 and also hinged at its opposite end to the end panel 17 along fold line 18. Similarly, the reinforcing strap 36 is struck from side wall panel 8 and is hinged at one of its ends to the end of handle panel 30 remote from medial panel 20 along a fold line 38 and also hinged at its opposite end to the end wall panel 12 along fold line 13. As shown in FIG. 2, the innermost edges of both the reinforcing straps 35 and 36 are spaced apart by an aperture 40 formed centrally of the carrier blank and diverge outwardly away from the handle panels 29 and 30. This feature is provided in order to prevent interlocking of the reinforcing straps during the glue machine feeding operation. This feature has the additional advantage of lowering the height of the side wall panels 8 and 14 thus providing better visibility of the articles e.g. bottles, accommodated within the carrier.

In order to provide reinforcement in the area of the handle panels 29 and 30 a 'T'-shaped intermediate handle reinforcement panel is provided and which comprises a pair of panels 41, 42 integral with and extending outwardly from medial panels 19 and 20 respectively, centrally of the carrier blank. Further reinforcement for the handle panels 29 and 30 is provided by adjacent areas of the medial panels 21 and 22 in which further hand gripping apertures 43, 44 are struck symetrically about the interrupted centre fold line 28. These areas provide an innermost reinforcement panel.

For the purpose of providing maximum article protection, partition means is provided for the interior of the carrier. More specifically transverse partitions 45 and 46 are hinged to a longitudinal partition 47 along spaced fold lines 48 and 49 respectively. The longitudinal partition 47 is provided at one of its ends with an anchoring tab 50 struck from medial panel 19 and which is hinged to the longitudinal partition 47 along spaced fold lines 51 and 52. The longitudinal partition 47 is provided at its opposite end with a supplementary transverse partition 53 hinged to the longitudinal partition 47 along a fold line 54. A further anchoring tab 55 is hinged to the free edge of transverse partition 45 along a fold line 56 and transverse partitions 45 and 46 are hinged to the medial panel 19 along fold lines 57 and 58 respectively.

At the other end of the blank, partition means is provided in the form of transverse partition 59 which is struck in part from the medial partition panel 21 and in part from the end panel 17 and has hinged thereto along a fold line 60 medial partition tab 21*a*. The partition means further comprise longitudinal partitions 61 and 62 which are hinged to transverse partition 59 along fold lines 63, 64 respectively. An anchoring tab 65 is hinged to the transverse partition 59 along fold lines 66 and 67. The longitudinal partition 61 and 62 also are hinged to the end wall panel 17 along fold lines 68 and 69 respectively.

Partition means on the other side of the carrier are similar to that just described and include a longitudinal partition 70 which is hinged to transverse partitions 71 and 72 along spaced fold lines 73 and 74 respectively. The longitudinal partition 70 is provided at one of its ends with an anchoring tab 75 which is hinged to the longitudinal partition 70 along spaced fold lines 76 and 77. At its opposite end the longitudinal partition 70 is provided with a supplementary transverse partition 78 whih is hinged to the partition panel 70 along a fold line 79. A further anchoring tap 80 is hinged to the free edge of transverse partition 71 along a fold line 81 and transverse partition 71 and 72 are further hinged to the medial panel 20 along fold lines 82 and 83 respectively.

At the other end of the carrier a transverse partition 84 is provided which is struck in part from the medial panel 22 and in part the end panel 12 and is hinged to the medial panel 22 along a fold line 85. Longitudinal panels 86 and 87 are hinged at one of their ends to the transverse partition 84 along spaced fold lines 88 and 89 respectively and at their other ends to the end wall panel 12 along fold lines 90 and 91 respectively. The transverse partition 84 is provided with an anchoring flap 92 which is hinged thereto along spaced fold lines 93 and 94.

In order to form the completed carrier from the unitary blank shown in FIG. 2, an application of glue is first made to anchoring tabs 50, 55, 75 and 80 and also to the intermediate handle reinforcing panels 41 and 42 together with areas of the medial panels 19 and 20 adjacent the interrupted fold line 27 as shown in stippling in FIG. 2.

Thereafter medial panels 19 and 20 together with their associated partition means are elevated and folded towards the right along fold lines 23 and 24 to occupy the positions shown in FIG. 3 of the drawings. By this operation, anchoring tabs 50 and 55 become adhered to end wall panel 15 and side wall 14, respectively and anchoring tabs 75 and 80 become adhered to end wall panel 10 and side wall 8, respectively. This first folding and glueing operation also causes the 'T'-shaped handle reinforcement panels and contiguous areas of the medial panels 19 and 20 adjacent interrupted centre fold line 27 to be adhered to the handle panels 29 and 30.

Following this operation, a further application of glue is made to anchoring tabs 65 and 92; a central area of transverse partition 59 intermediate the spaced fold lines 63 and 64, a central area of transverse panel 84 intermediate the spaced fold lines 88 and 89, a portion of longitudinal partition 61 adjacent the fold line 63, a portion of longitudinal panel 87 adjacent the fold line 89, the central handle reinforcing area of the medial panels 21 and 22 adjacent the interrupted centre fold line 28 and also two areas of the end wall panels 12 and 17 adjacent the central aperture 40 of the blank, as indicated by stippling in FIG. 3. The medial partition tab 21*a*, is then folded downwardly as viewed in FIG. 3 along fold line 60. Following this end wall panels 17 and 12 and medial panels 21 and 22 together with the associated partition means are all elevated and folded toward the left along fold lines 18 and 13.

After this operation, anchoring tab 65 and 92 are adhered to side walls 14 and 8 respectively. Also, the central areas of transverse partitions 59 and 84 are adhered to the then upper faces of supplementary transverse partitions 53 and 78, respectively, and the glued areas of longitudinal partitions 61 and 87 are adhered to those areas of the longitudinal partitions 47 and 70 adjacent their respectively supplementary transverse partition panels. This latter feature connects together the longitudinal partitions on each side of the medial partitions and thus makes for positive folding of partitions 61 and 87 during the carrier set-up operation. Moreover, the glued central handle reinforcing area of the medial partition panels 21 and 22 are adhered to the then upper faces of 'T'-shaped panels 41, 42 further to reinforce the handle structure of the carrier and the glued areas of end wall panels 17 and 12 bordering the central aperture 40 are adhered to the reinforcing straps 35 and 36. The carrier elements then appear as shown in FIG. 4 of the drawings.

Following this a further application of glue is made to the exposed portions of medial panels 19 and 20 as well as to the exposed central areas of medial panels 21 and 22 together with a small area of the folded back medial partition tab 21*a* as indicated by stippling in FIG. 4. Thereafter the portion of the blank above the interrupted centre fold lines 27 and 28 is elevated and folded over to occupy the position shown in FIG. 5 so that the glued areas of the medial panels are adhered together and so that the medial partition tab 21*a* is adhered to medial partition panel 22. A still further application of glue is then made to the glue flap 2 as indicated by stippling in FIG. 5.

The carrier is then folded along medial fold lines 1*a*, 4*a* and 6*a* to occupy the position shown in FIG. 6 so as to cause glue flap 2 to be adhered to the lower portion of side wall 14 which position represents the completed carrier in a collapsed condition.

In order to set up the carrier from the collapsed condition shown in FIG. 6 it is simply necessary to prevent movement of the carrier toward the left than to apply pressure to the medial edges of end wall panels 12 and 17. By this operation, the side walls are moved into a position perpendicular to the end wall panels and simultaneously the bottom wall is folded into a flat plane. The carrier then appears as shown in FIG. 7. On completion of this erecting operation glue is applied to the auxiliary glue flap 4 as well as to auxiliary panel 6 as shown by stippling in FIG. 7 and both elements are then folded upwardly along fold lines 5 and 7 respectively. By this operation, the portions of end wall panels 12 and 17 from which transverse partitions 59 and 84 are struck are covered by the auxiliary panel 6.

Therefore by this invention an article carrier is provided which accommodates a large number of primary packages and at the same time provides a strong handle construction and maximum article separation with a minimum of material. In this connection, it will be appreciated that the combination of the inner, intermediate and outer handle panels provides a handle structure having a six-ply thickness of material. Additional strength is, of course, provided by the reinforcing straps which connect the handle structure to the end wall at one end of the carrier.

I claim:

1. A cellular article carrier comprising a bottom wall, spaced side walls hinged respectively to opposite side edges of the bottom wall, end wall panels hinged respectively to the end edges of said side walls and extending inwardly therefrom, a medial partition structure at one end of the carrier hinged to said end wall panels at said one end of the carrier and extending medially inward of the carrier, a medial partition structure at the other end of the carrier hinged to said end wall panels at said other end of the carrier and extending medially inward of the carrier, partitioning means providing a plurality of individual article cells on each side of said medial partition structures, a handle structure comprising an inner handle structure provided by the medial partition structure at said one end of the carrier and an outer handle structure secured in overlapping relationship with respect to said inner handle structure and extending between the opposite end wall panels of the carrier, said outer handle structure including reinforcing straps hinged thereto and secured to the end wall panels at said one end of the carrier.

2. A cellular article carrier according to claim 1 in which said handle structure further comprises an intermediate handle reinforcing panel integral with the medial partition structure at said other end of the carrier and secured in overlapping relationship with respect to said inner handle structure and with respect to said outer handle structure.

3. A cellular article carrier according to claim 1 or claim 2 in which one reinforcing strap is struck from each of said side walls of the carrier.

4. A cellular article carrier according to claim 1 or claim 2 in which said outer handle structure is struck partially from the end wall panels at said other end of the carrier and partially from each of said side walls of the carrier.

5. A cellular article carrier according to claim 4 in which said outer handle structure is hinged at one of its ends to the medial partition structure at said other end of the carrier and at the other of its ends to said reinforcing straps.

6. A cellular article carrier according to claim 2 in which said inner handle structure, said outer handle structure and said intermediate handle reinforcing panel each comprise a pair of panels folded and secured together so as to provide a six-ply handle structure.

7. A cellular article carrier according to claim 1 or claim 2 in which the medial partition structure at said other end of the carrier comprises a pair of medial panels from each of which panels is struck a pair of transverse partitions and hinged thereto, and a longitudinal partition struck from each of said medial panels and hinged to the respective pairs of transverse partitions, and in which the medial partition structure at said one end of the carrier comprises a pair of medial panels from each of which panels is struck a transverse partition, each of said transverse partitions also being struck from respective ones of the end wall panels at said one end of the carrier and being hinged to its associated medial panel, each of said transverse partitions being further hinged to a pair of longitudinal partitions, each pair of longitudinal partitions being struck from respective ones of said end wall panels and hinged thereto, and wherein each longitudinal partition at said other end of the carrier is secured in face to face overlapping relationship with one longitudinal partition in each of said pairs of longitudinal partitions at said one end of the carrier.

8. A cellular article carrier comprising a bottom wall, spaced side walls hinged respectively to opposite side edges of the bottom wall, end wall panels hinged respectively to the end edges of said side walls and extending inwardly therefrom, medial partition structure hinged to the edges of said end wall panels remote from said side walls and extending medially inward of said carrier, said medial partition struture comprising a pair of medial panels, a pair of transverse partitions struck from one of said medial panels and hinged thereto, a longitudinal partition struck from said one medial panel and hinged to said pair of transverse partitions, a pair of longitudinal partitions struck from one of said end wall panels and hinged thereto, a transverse partition struck from the other of said medial panels and from said one end wall panel and hinged to said pair of longitudinal partitions and to said other medial panel and wherein said one longitudinal partition is connected to one of said pair of longitudinal partitions in face to face overlapping relationship.

* * * * *